US007832242B2

(12) United States Patent
Brandstätter et al.

(10) Patent No.: US 7,832,242 B2
(45) Date of Patent: Nov. 16, 2010

(54) METHOD FOR PRODUCING A HARDENED PROFILE PART

(75) Inventors: Werner Brandstätter, Linz (AT); Herbert Eibensteiner, Droβ (AT); Martin Fleischanderl, Rainbach i.M (AT); Josef Faderl, Steyr (AT); Gerald Landl, Linz (AT); Anna Elisabeth Raab, Linz (AT); Siegfried Kolnberger, Pasching (AT)

(73) Assignee: voestalpine Stahl GmbH, Linz (AT)

( * ) Notice: Subject to any disclaimer, the term of this patent is extended or adjusted under 35 U.S.C. 154(b) by 792 days.

(21) Appl. No.: 10/566,069

(22) PCT Filed: Jun. 9, 2004

(86) PCT No.: PCT/EP2004/006250

§ 371 (c)(1), (2), (4) Date: May 1, 2007

(87) PCT Pub. No.: WO2005/021820

PCT Pub. Date: Mar. 10, 2005

(65) Prior Publication Data

US 2007/0271978 A1 Nov. 29, 2007

(30) Foreign Application Priority Data

Jul. 29, 2003 (AT) ..... A 1202/2003
Jul. 29, 2003 (AT) ..... A 1203/2003

(51) Int. Cl.
*B21D 22/00* (2006.01)

(52) U.S. Cl. ..... 72/47; 72/46; 72/168; 72/177; 72/202; 72/342.6; 72/364; 148/262; 205/192; 205/220; 205/222

(58) Field of Classification Search ..... 148/262; 72/46, 47, 168, 177, 200, 202, 342.1, 342.5, 72/342.6, 364; 205/192, 220, 222, 224, 227, 205/228, 230, 232, 244, 305
See application file for complete search history.

(56) References Cited

U.S. PATENT DOCUMENTS 4,830,683 A * 5/1989 Ferguson ..... 148/648

(Continued)

FOREIGN PATENT DOCUMENTS

DE 101 20 063 C2 11/2002

(Continued)

OTHER PUBLICATIONS

Weinberg, F. et al, "Segregation in Galfan Hot Dipped Sheet Steel", Canadian Metallurgical Quarterly, 1990, pp. 163-166, vol. 29, No. 2, Pergamon Press plc, Great Britain.

*Primary Examiner*—David B Jones
(74) *Attorney, Agent, or Firm*—Setter Roche LLP

(57) ABSTRACT

The invention relates to a method for producing a hardened profiled structural part from a hardenable steel alloy with cathodic corrosion protection. The method includes applying a coating to a sheet made of a hardenable steel alloy, wherein the coating comprises zinc, and the coating further comprises one or several elements with affinity to oxygen in a total amount of 0.1 weight-% to 15 weight-% in relation to the total coating. After applying the coating, the coated sheet steel is roller-profiled in a profiling device. Thereafter, the coated sheet steel is heated to a structural change required for hardening. A skin made of an oxide of the element(s) with affinity to oxygen is formed on the surface of the coating. After sufficient heating the sheet is cooled, wherein the rate of cooling is set in such a way that hardening of the sheet alloy is achieved.

28 Claims, 10 Drawing Sheets

U.S. PATENT DOCUMENTS

| | | | | |
|---|---|---|---|---|
| 4,978,586 | A * | 12/1990 | Chambaere et al. | 428/625 |
| 5,316,052 | A * | 5/1994 | Ritter et al. | 140/112 |
| 6,178,800 | B1 * | 1/2001 | Edmonds et al. | 72/342.94 |
| 6,564,604 | B2 * | 5/2003 | Kefferstein et al. | 72/47 |
| 2003/0059643 | A1 * | 3/2003 | Kim et al. | 428/626 |

FOREIGN PATENT DOCUMENTS

| | | | |
|---|---|---|---|
| DE | 102 46 614 | A1 | 4/2004 |
| EP | 1 013 785 | A1 | 6/2000 |
| EP | 1 439 240 | A1 | 7/2004 |
| EP | 1439240 | A1 * | 7/2004 |
| FR | 2 534 161 | | 4/1984 |
| JP | 4002758 | | 1/1992 |
| JP | 6256925 | | 9/1994 |
| WO | 03/035922 | | 5/2003 |
| WO | WO 03035922 | A1 * | 5/2003 |

* cited by examiner

METALLURGICAL ANALYTICS AND SURFACE ANALYTICS

METALLURGICAL ANALYTICS AND SURFACE ANALYTICS

METALLURGICAL ANALYTICS AND SURFACE ANALYTICS

METALLURGICAL ANALYTICS AND SURFACE ANALYTICS

METHOD FOR PRODUCING A HARDENED PROFILE PART

FIELD OF THE INVENTION

The invention relates to a method for producing a hardened profiled structural part from a hardenable steel alloy with cathodic corrosion protection. The invention further relates to a cathodic corrosion-protection layer for hardened profiled structural parts. Furthermore, the invention relates to a hardened profiled section with cathodic corrosion protection.

BACKGROUND OF THE INVENTION

After having been created by suitable forming steps, either by hot-rolling or cold-rolling, low-alloy sheet steel for automobile body construction is not corrosion-resistant. This means that oxidation occurs on the surface already after a relatively short time because of humidity in the air.

It is known to protect sheet steel against corrosion by means of appropriate corrosion-protection layers. In accordance with DIN-50900, Part 1, corrosion is defined as the reaction of a metallic material with its surroundings, which causes a measurable change in the material and can lead to a degradation of the function of a metallic structural part or an entire system. To prevent corrosion damage, steel is customarily protected, so that it withstands corrosion damage during the required period of use. The prevention of corrosion damage can take place by affecting the properties of the reaction partners and/or by changing the reaction conditions, separation of the metallic material from the corrosive medium by means of applied protective layers, as well as by electrochemical steps.

In accordance with DIN 50902, a corrosion-protection layer is a layer produced on a metal, or in the area of the surface of a metal, which consists of one or several layers. Multi-layered coatings are also called corrosion-protection systems.

Possible corrosion-protection layers are, for example, organic coatings, inorganic coatings and metallic coverings. The purpose of metallic corrosion-protection layers lies in transferring the properties of the applied material to the steel surface for as long as possible a time. Accordingly, the selection of an effective metallic corrosion protection presupposes the knowledge of the corrosion-chemical connections in the system of steel/coating material/corrosive medium.

The coating metals can be electro-chemically nobler, or electro-chemically less noble in comparison with steel. In the first case the respective coating metal protects the steel by the formation of protective layers alone. This is referred to as so-called barrier protection. As soon as the surface of the coating metal has pores or is damaged, a "local element" is formed in the presence of moisture, in which the base partner, i.e. the metal to be protected, is attacked. Among the nobler coating metals are tin, nickel and copper.

On the one hand, base metals produce protective covering layers, on the other hand they are additionally attacked in case of leaks in the layers, since in comparison with steel they are more base. In case of damage to such a coating layer, the steel is accordingly not attacked, instead first the baser coating metal corrodes because of the formation of local elements. This is referred to as a so-called galvanic or cathodic corrosion protection. Zinc, for example, is among the baser metals.

Metallic protective layers are applied in accordance with various methods. Depending on the metal and the method, the connection with the steel surface is of a chemical, physical or mechanical type and extends from alloy formation and diffusion to adhesion and mere mechanical cramping.

The metallic coatings should have technological and mechanical properties similar to steel and should also behave similar to steel in connection with mechanical stresses or plastic deformations. Accordingly, the coatings should not be damaged in the course of forming and should not be negatively affected by forming processes.

When applying hot-dip galvanizing coatings, the metal to be protected is immersed in liquid metallic melts. Appropriate alloy layers are formed at the phase boundary between steel and the coating metal by dipping in the melt. An example of this is hot-dip galvanizing.

In the course of hot-dip galvanizing, the steel tape is conducted through a zinc bath, wherein the zinc bath has a temperature of roughly 450° C. Hot-dip galvanized products show great corrosion resistance, are well suited to welding and forming, their main areas of use are in the construction, automobile and home appliance industries.

Moreover, the creation of a coating from a zinc-iron alloy is known. To this end, following hot-dip galvanizing these products are subjected to diffusion-annealing at temperatures above the melting point of zinc, generally between 480° C. and 550° C. In the process, the zinc-iron alloy layers grow and eat up the zinc layer above. This method is called "galvannealing". The zinc-iron alloy created in this way also has a high corrosion resistance, is well suited to welding and forming. Main areas of use are the automobile and household appliance industries. By dipping into a melt it is moreover also possible to produce other coatings from aluminum-silicon, zinc-aluminum and aluminum zinc.

The production of electrolytically-deposited metal coatings is furthermore known, i.e. the electrolytic deposition of metal coatings from electrolytes taking place by means of the passage of electrical current.

Electrolytic coating is also possible in connection with those metals which cannot be coated by means of the hot-dip galvanizing method. With electrolytic coating, customary layer thicknesses mainly lie between 2.5 and 10 μm, they are therefore thinner than coatings produced by the hot-dip galvanizing method. Some metals, for example zinc, also permit thick-film coatings in case of electrolytic coating. Electrolytically zinc-coated metal sheets are primarily employed in the automobile industry, because of the great surface quality, these metal sheets are mainly employed in the area of the outer skin. They are easy to form, are suitable for welding and have a good storage capability, as well as surfaces which are easy to paint and are matte.

In automobile construction in particular, efforts are being made to make the body continuously lighter. This is connected on the one hand with the fact that lighter vehicles use less fuel, on the other hand vehicles are more and more equipped with additional functions and additional units, which entails an increase in weight, which is intended to be compensated by a lighter shell.

However, at the same time the requirements made on safety of motor vehicles are increasing, wherein the body is responsible for the safety of the people in a motor vehicle and their protection in case of accidents. Accordingly, in connection with lighter gross weight of the body there is the requirement for providing increased safety in case of accidents. This is possible only by employing materials of increased sturdiness, in particular in the area of the passenger compartment.

In order to obtain the required sturdiness it is necessary to use types of steel with increased mechanical properties, or to treat the types of steel used in such a way that they have the required properties.

For providing sheet steel with increased sturdiness it is known to form structural steel parts in one step and to harden them at the same time. This method is also called "press hardening". In the course of this a piece of sheet steel is heated to a temperature above the austenizing temperature, customarily above 900° C., and is subsequently formed in a cold tool. In the process the tool forms the hot piece of sheet steel which, because of its surface contact with the cold mold, is very rapidly cooled, so that the per se known hardening effects in connection with steel occur. It is furthermore known to first form the sheet steel and subsequently to cool the formed structural sheet steel part in a calibrating press and to harden it. In contrast to the first method it is advantageous here that the sheet metal is formed in the cold state and more complex shapes can be obtained in this way. However, in connection with both methods the sheet metal surface is oxidized by the heating, so that the surface of the sheet metal must be cleaned after forming and hardening, for example by sandblasting. The sheet metal is subsequently cut, and possibly required holes are punched out. In the course of this it is disadvantageous that the sheets have a large hardness during mechanical processing and therefore processing becomes expensive and a large amount of tool wear occurs in particular.

The aim of U.S. Pat. No. 6,564,604 B2 is to make available pieces of sheet steel which are subsequently subjected to heat treatment, as well as making available a method for producing parts by press-hardening these coated pieces of sheet steel. It is intended here to assure in spite of the temperature increase that the sheet steel does not decarbonize and the surface of the sheet steel does not oxidize prior to, during and after hot-pressing or the heat treatment. To this end it is intended to apply an alloyed inter-metallic mixture to the surface prior to or following stamping, which is intended to provide protection against corrosion and decarbonization and in addition can provide a lubrication function. In one embodiment this publication proposes the use of a customary, apparently electrolytically applied zinc layer, wherein this zinc layer is intended to be converted into a homogeneous Zn—Fe-alloy layer together with the steel substrate during a subsequent austenization of the sheet metal substrate. This homogeneous layer structure is verified by means of microscopic photos. In contrast to earlier assumptions, this coating is said to have a mechanical resistance capability which protects it against melting. However, such an effect is not shown in actual use. In addition, the use of zinc or zinc alloys is intended to offer a cathodic protection of the edges if cuts are being made. However, it is disadvantageous in connection with this embodiment that with such a coating—contrary to the statements in this publication—there is hardly any corrosion protection of the edges and, if this layer is damaged, only a poor corrosion protection is achieved in the area of the sheet surface.

A coating is disclosed in the second example of U.S. Pat. No. 6,564,604 B2, 50% to 55% of which consist of aluminum, 45% to 55% of zinc, and possibly small amounts of silicon. Such a coating is not new per se and is known under the name Galvalume®. It is stated that the coating metals zinc and aluminum are said to form, together with iron, a homogeneous zinc-aluminum-iron alloy coating. In connection with this coating it is disadvantageous that a sufficient cathodic corrosion protection is no longer achieved by means of it, but in connection with its use in the press-hardening method the predominant barrier protection achieved with it is not sufficient, since damage to partial areas of the surface is unavoidable. In summary it can be stated that the method described in this publication is not capable of solving the problem that generally cathodic corrosion layers on the basis of zinc are not suitable for protecting sheet steel which is intended to be subjected to heat treatment following coating, and are moreover subjected to a further shaping or forming step.

A method for producing a structural sheet metal part is known from EP 1 013 785 A1, wherein the sheet metal is said to have an aluminum layer or an aluminum alloy layer on its surface. A structural sheet metal part provided with such coatings is intended to be subjected to a press-hardening process, wherein an alloy with 9 to 10% silicon, 2 to 3.5% iron, the remainder aluminum with impurities, and a second alloy with 2 to 4% iron and the remainder aluminum with impurities, are cited as possible coating alloys. Such coatings are known per se and correspond to the coating of hot-dip-aluminized sheet steel. The disadvantage in connection with such a coating is that only a so-called barrier protection is achieved. In the instant such a protective barrier coating is damaged, or in case of cracks in the Fe—Al layer, the base material, in this case the steel, is attacked and corrodes. No cathodic protective effects are provided.

Moreover, it is disadvantageous that in the course of heating the sheet steel to the austenizing temperature and the subsequent press-hardening step, such a hot-dip-aluminized coating is chemically and mechanically stressed to such an extent that the finished structural part does not have a sufficient corrosion-protective layer. As a result it can therefore be stated that such a hot-dip-aluminized coating is not well suited to press-hardening into complex geometrical shapes, i.e. for heating sheet steel to a temperature which lies above the austenizing temperature.

A method for producing a coated structural part for vehicle production is known from DE 102 46 614 A1. This method is intended for solving the problems of the previously mentioned European Patent Application 1 013 785 A1. In particular, it is stated that in accordance with the dipping process of European Patent Application 1 013 785 A1 an inter-metallic phase is said to already be formed in the course of coating the steel, wherein this alloy layer between the steel and the actual coating is said to be hard and brittle and to tear during cold-forming. Because of this, micro-cracks are said to be formed up to such a degree that the coating itself is detached from the basic material and in this way loses its protective effects. Therefore DE 102 46 614 A1 proposes to apply a coating in the form of metal or a metal alloy by means of a galvanic coating method in an organic, non-aqueous solution, wherein aluminum or an aluminum alloy is said to be a particularly well suited, and therefore preferred coating material. Alternatively zinc or zinc alloys would also be suitable. Sheet metal coated in this way can subsequently be preformed cold and finished hot. However, with this method the disadvantage is that an aluminum coating, even if applied electrolytically, no longer offers corrosion protection in case of damage to the surface of the finished structural part, since the protective barrier was breached. In connection with an electrolytically deposited zinc coating it is disadvantageous that the greater portion of the zinc oxidizes during heating for heat forming and is no longer available for cathodic protection. The zinc evaporates in the protective gas atmosphere.

A method for producing metallic profiled structural parts for motor vehicles is known from DE 101 20 063 C2. In connection with this method for producing structural metallic profiled parts for motor vehicles, a starting material made available in the form of tape is fed to a roller profiling unit and is formed into a rolled profiled section. Following the exit from the roller profiling unit it is intended to heat at least partial areas of the rolled profiled section inductively to a temperature required for hardening and to subsequently quench them in a cooling unit. Thereafter the rolled profiled sections are cut into the profiled structural parts. A particular advantage of roller profiling is said to lie in the low manufacturing costs because of the high processing speed, and tool costs which are lower in comparison with a pressing tool. A defined tempered steel is used for the profiled structural part. In accordance with an alternate of this method it is also possible to inductively heat partial areas of the starting material prior to their entry into the roller profiling unit to the temperature required for hardening and to quench it in a cooling unit prior to cutting off the rolled profiled sections. In connection with the second alternative it is disadvantageous that cutting to size must take place already in the hardened state, which is problematical because of the great hardness of the material. It is furthermore disadvantageous that in the already described prior art the profiled structural parts cut to size must be cleaned, or descaled, and that a corrosion-protection coating must be applied after descaling, wherein such corrosion-protection coatings customarily do not provide a very good cathodic corrosion protection.

OBJECT AND SUMMARY OF THE INVENTION

It is an object of the invention to create a method for producing a hardened profiled structural part with cathodic corrosion protection, wherein the cathodic corrosion protection is designed in such a way that the starting material already has a protective coating which is not changed in a negative manner during further processing.

It is a further object to create a cathodic corrosion-protection layer for hardenable profiled structural parts.

It is a further object to create a hardened profiled structural part with cathodic corrosion protection.

The method in accordance with the invention provides the application to hardenable sheet steel of a coating made of a mixture substantially consisting of zinc and of an element with affinity to oxygen, such as magnesium, silicon, titanium, calcium and aluminum, with a content of 0.1 to 15 weight-% of the element with affinity to oxygen, and to heat the coated sheet steel at least in partial areas with the admission of oxygen to a temperature above the austenizing temperature of the sheet alloy and to form it before this, wherein the sheet is cooled after it has been sufficiently heated and the cooling rate is set in such a way that hardening of the sheet alloy takes place. As a result a hardened structural part made of sheet steel is obtained which provides good cathodic corrosion protection.

The corrosion protection in accordance with the invention for sheet steel, which is initially formed and in particular roller-profiled and thereafter is subjected to a heat treatment and formed and hardened in the process, is a cathodic corrosion protection which is substantially based on zinc. In accordance with the invention, 0.1% up to 15% of one or several elements with affinity to oxygen, such as magnesium, silicon, titanium, calcium, aluminum, boron and manganese, or any mixture or alloy thereof, are added to the zinc constituting the coating. It was possible to determine that such small amounts of elements with affinity to oxygen, such as magnesium, silicon, titanium, calcium, aluminum, boron and manganese, result in a surprising effect.

In accordance with the invention, at least Mn, Al, Ti, Si, Ca, B, Mn are possible elements with affinity to oxygen. In the following, whenever aluminum is mentioned, it is intended to also stand for all of the other elements mentioned here.

The application of the coating in accordance with the invention to sheet steel can take place, for example, by so-called hot-dip galvanizing, i.e. melt-dip coating, wherein a liquid mixture of zinc and the element(s) with affinity to oxygen is applied. It is furthermore possible to apply the coating electrolytically, i.e. to deposit the mixture of zinc and the element(s) with affinity to oxygen together on the sheet surface, or first to deposit a zinc layer and then in a second step to deposit one or several of the elements with affinity to oxygen on the zinc surface one after the other, or any desired mixture or alloy thereof, or to deposit them by evaporation or other suitable methods.

It has been surprisingly shown that, in spite of the small amount of an element with affinity to oxygen, such as aluminum in particular, a protective layer clearly forms on the surface during heating, which substantially consists of $Al_2O_3$, or an oxide of the element with affinity to oxygen (MgO, CaO, TiO, $SiO_2$, $B_2O_3$, MnO), is very effective and self-repairing. This very thin oxide layer protects the underlying Zn-containing corrosion-protection layer against oxidation, even at very high temperatures. This means that in the course of the special continued processing of the zinc-coated sheet during the press-hardening method an approximately two-layered corrosion-protection layer is formed, which consists of a cathodically highly effective layer with a high proportion of zinc, which is protected against oxidation and evaporation by a very thin oxidation-protection layer consisting of one or several oxides ($Al_2O_3$, MgO, CaO, TiO, $SiO_2$, $B_2O_3$, MnO). Thus, the result is a cathodic corrosion-protection layer of an outstanding chemical durability. This means that the heat treatment must take place in an oxidizing atmosphere. Although it is possible to prevent oxidation by means of a protective gas (oxygen-free atmosphere), the zinc would evaporate because of the high vapor pressure.

It has furthermore been shown that the corrosion-protection layer in accordance with the invention has so great a mechanical stability in connection with the press-hardening method that a forming step following the austenization of the sheets does not destroy this layer. Even if microscopic cracks occur, the cathodic protection effect is at least clearly greater than the protection effect of the known corrosion-protection layers for the press-hardening method.

To provide a sheet with the corrosion protection in accordance with the invention, in a first step a zinc alloy with an aluminum content in weight-% of greater than 0.1, but less than 15%, in particular less than 10%, and further preferred of less than 5%, can be applied to sheet steel, in particular alloyed sheet steel, whereupon in a second step the sheet is formed in-line into a strand, is heated with the admission of atmospheric oxygen to a temperature above the austenization temperature of the sheet alloy and thereafter is cooled at an increased speed.

It is assumed that in the first step of the method, namely in the course of coating the sheet on the sheet surface, or in the proximate area of the layer, a thin barrier phase of $Fe_2Al_{5-x}Zn_x$ in particular is formed, which prevents Fe—Zn diffusion in the course of a liquid metal coating process taking place in particular at a temperature up to 690° C. Thus, in the first method step a sheet with a zinc-metal coating with the addition of aluminum is created, which has an extremely thin barrier phase only toward the sheet surface, as in the proximal area of the coating, effective against a rapid growth of a zinc-iron connection phase. It is furthermore conceivable that the presence of aluminum alone lowers the iron-zinc diffusion tendency in the area of the boundary layer.

If now in the second step heating of the sheet provided with a metallic zinc-aluminum layer to the austenization temperature of the sheet material takes place with the admission of atmospheric oxygen, initially the metal layer on the sheet is liquefied. The aluminum, which has affinity to oxygen, is reacted out of the zinc on the distal surface with atmospheric oxygen while forming a solid oxide, or an oxide of aluminum, because of which a decrease in the aluminum metal concentration is created in this direction, which causes a continuous diffusion of aluminum towards depletion, i.e. in the direction toward the distal area. This enrichment with oxide of aluminum at the area of the layer exposed to air now acts as an oxidation protection for the layer metal and as an evaporation barrier for the zinc.

Moreover, during heating, the aluminum is drawn out of the proximal barrier phase by continuous diffusion in the direction toward the distal area and is available there for the formation of a surface $Al_2O_3$ layer. In this way the formation of a sheet coating is achieved which leaves behind a cathodically highly effective layer with a large proportion of zinc.

For example, a zinc alloy with a proportion of aluminum in weight-% of greater than 0.2, but less than 4, preferably of a size of 0.26, but less than 2.5 weigh-%, is well suited.

If in an advantageous manner the application of the zinc alloy layer to the sheet surface takes place in the first step in the course of passing through a liquid metal bath at a temperature greater than 425° C., but lower than 690° C., in particular at 440° C. to 495° C., with subsequent cooling of the coated sheet, it is not only effectively possible to form a proximal barrier phase, or to observe a good diffusion prevention in the area of the barrier layer, but an improvement of the heat deformation properties of the sheet material also takes place along with this.

An advantageous embodiment of the invention is provided by a method in which a hot- or cold-rolled steel tape of a thickness greater than 0.15 mm, for example, is used and within a concentration range of at least one of the alloy elements within the limits, in weight-%, of

| | | |
|---|---|---|
| Carbon | up to 0.4 | preferably 0.15 to 0.3 |
| Silicon | up to 1.9 | preferably 0.11 to 1.5 |
| Manganese | up to 3.0 | preferably 0.8 to 2.5 |
| Chromium | up to 1.5 | preferably 0.1 to 0.9 |
| Molybdenum | up to 0.9 | preferably 0.1 to 0.5 |
| Nickel | up to 0.9 | |
| Titanium | up to 0.2 | preferably 0.02 to 0.1 |
| Vanadium | up to 0.2 | |
| Tungsten | up to 0.2 | |
| Aluminum | up to 0.2 | preferably 0.02 to 0.07 |
| Boron | up to 0.01 | preferably 0.0005 to 0.005 |
| Sulfur | 0.01 max. | preferably 0.008 max. |
| Phosphorus | 0.025 max | preferably 0.01 max. |

the rest iron and impurities.

It was possible to determine that the surface structure of the cathodic corrosion protection in accordance with the invention is particularly advantageous in regard to the adhesiveness of paint and lacquer.

The adhesion of the coating on the object made of sheet steel can be further improved if the surface layer has a zinc-rich intermetallic iron-zinc-aluminum phase and an iron-rich iron-zinc-aluminum phase, wherein the iron-rich phase has a ratio of zinc to iron of at most 0.95 ($Zn/Fe \leqq 0.95$), preferably of 0.20 to 0.80 ($Zn/Fe=0.20$ to 0.80), and the zinc-rich phase a ratio of zinc to iron of at least 2.0 ($Zn/Fe \geqq 2.0$), preferably of 2.3 to 19.0 ($Zn/Fe=2.3$ to 19.0).

The starting material provided in a tape shape with the coating in accordance with the invention is conducted to a roller profiling unit and is formed into a rolled profiled section, wherein the rolled profiled section is formed during the roller profiling process and is subsequently cut into profiled structural parts in a cutting unit. In accordance with the invention, after leaving the roller profiling unit, or prior to entering the roller profiling unit, the rolled profiled sections are heated to a temperature required for hardening and are quenched in a cooling unit prior to being cut. The required heating takes place inductively, for example.

In a further advantageous embodiment, starting material, which is made available in tape form, is conducted to a roller profiling unit and is formed into a roller profiled section in the roller profiling unit, wherein the roller profiled section is deformed in the course of the roller profiling process, and subsequently the roller profiled section is cut into profiled structural parts in a cutting unit. Subsequently the already final cut profiled structural parts are individually stored in a profiled parts storage device and are subsequently subjected to the hardening step by being heated and cooled.

A further advantageous embodiment provides to subject the individual profiled sections prior to hardening to an intermediate heating stage with the admission of oxygen, wherein an advantageous change of the corrosion-protection layer takes place in the intermediate heating stage, and only then to heat them to a temperature required for hardening. The latter can take place in connection with tape material, as well as with cut-to-size profiled sections.

In principle it is possible to create open and closed profiled sections by means of inductive high-frequency welding, laser welding, spot welding, rolled bead welding, projection welding and rolling technology.

The invention will be explained by way of example in what follows by means of the drawings.

DETAILED DESCRIPTION OF THE PREFERRED EMBODIMENTS

Figure 1:
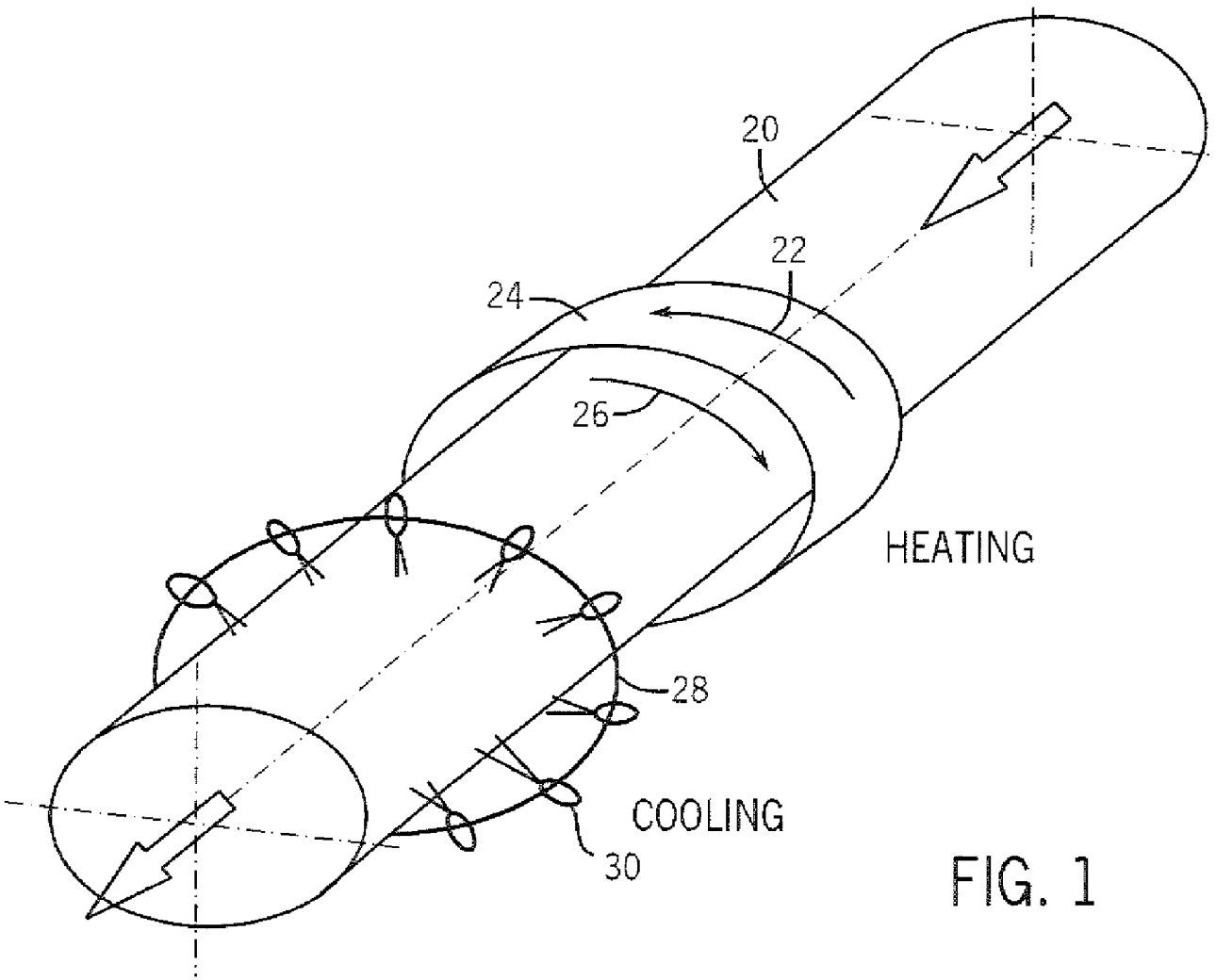
FIG. 1 schematically shows a device with an induction coil and cooling ring for producing hardened profiled structural parts.

FIG. 1 schematically shows a profiled tube 20 with an inductive current 22 running through an induction coil 24 and a resulting induced eddy current 26, as well as a cooling ring 28 that includes a cooling liquid 30, for producing hardened profiled structural parts.

Figure 2:
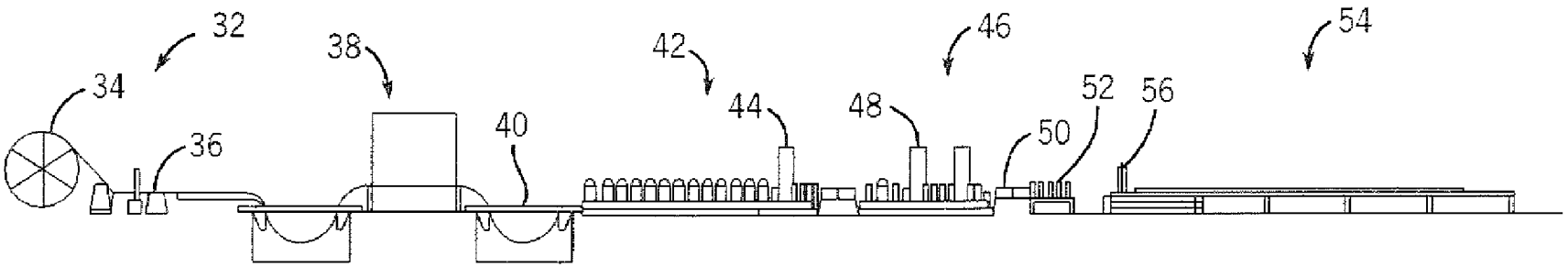
FIG. 2 schematically shows a device for producing the structural parts in accordance with the invention.

FIG. 2 schematically shows a device for producing the structural parts in accordance with the invention. In particular, a tape preparation element 32 includes a tape unwinding device 34 and a welding element 36. Next, an advance stamping machine 38 includes a loop 40. Following the advance stamping machine 38, a profiling machine 42 includes a welding device 44. Next, a roll form hardening element 46 includes an induction coil 48, a cooling device 50, and a calibration device 52. Finally, an outlet roller element 54 includes a flying cutting unit 56.

Figure 3:
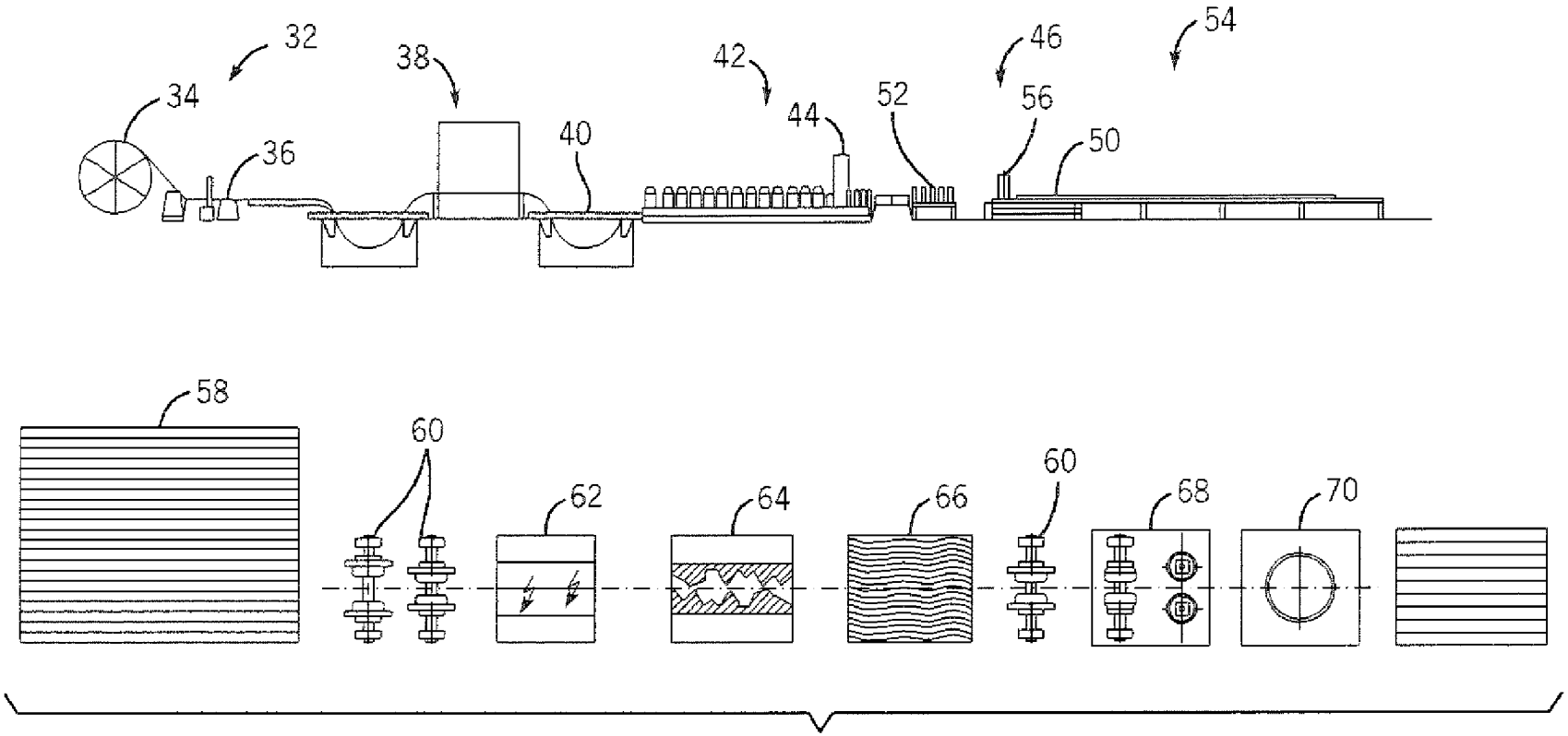
FIG. 3 shows a further embodiment of a device for producing the structural parts.
Figure 4:
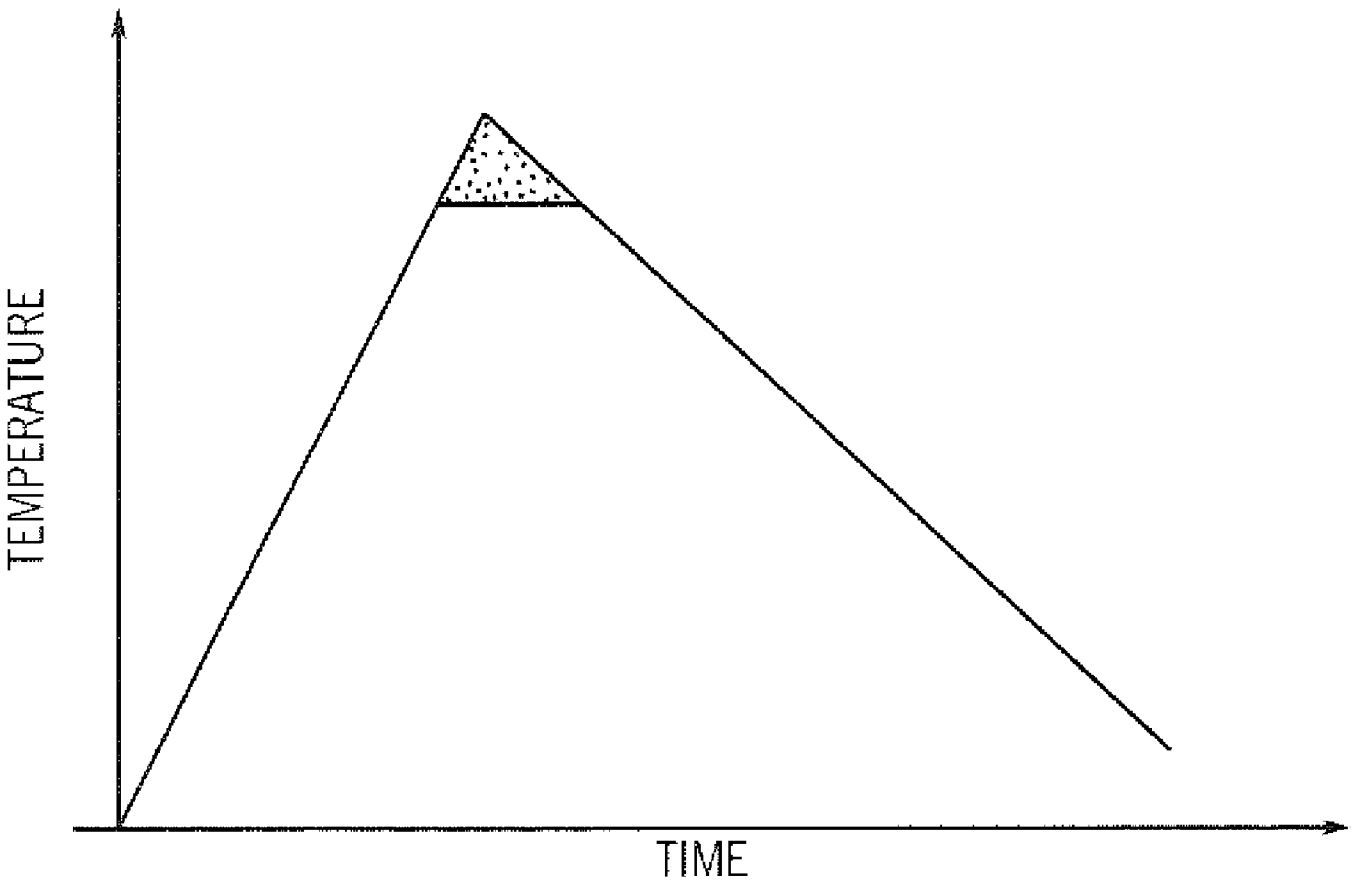
FIG. 4 schematically shows the course of temperature and time when producing the profiled structural part in accordance with the invention.
Figure 5:
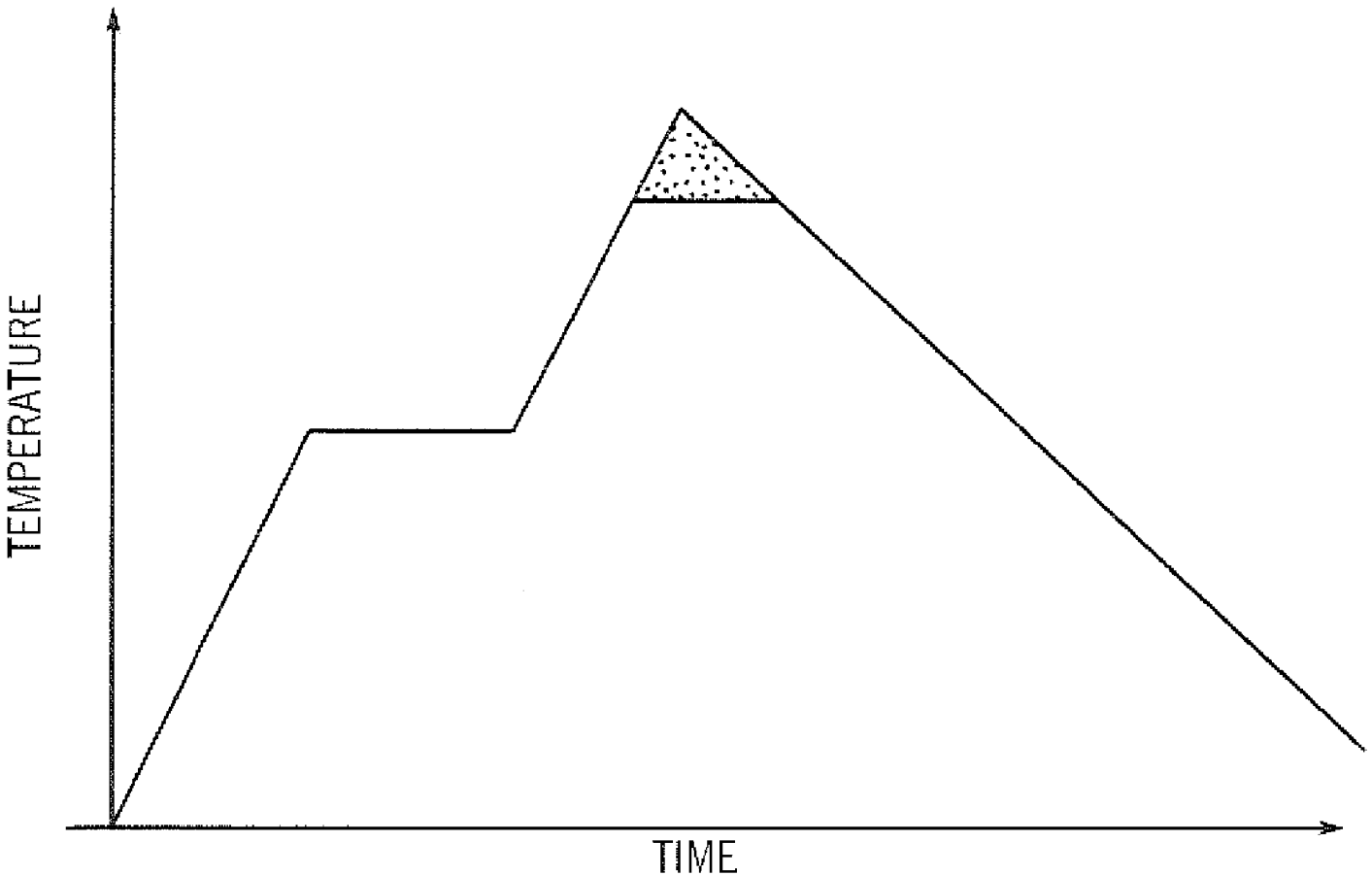
FIG. 5 shows a course of temperature and time in connection with a further advantageous embodiment of the method for producing the profiled structural part in accordance with the invention.
Figure 6:
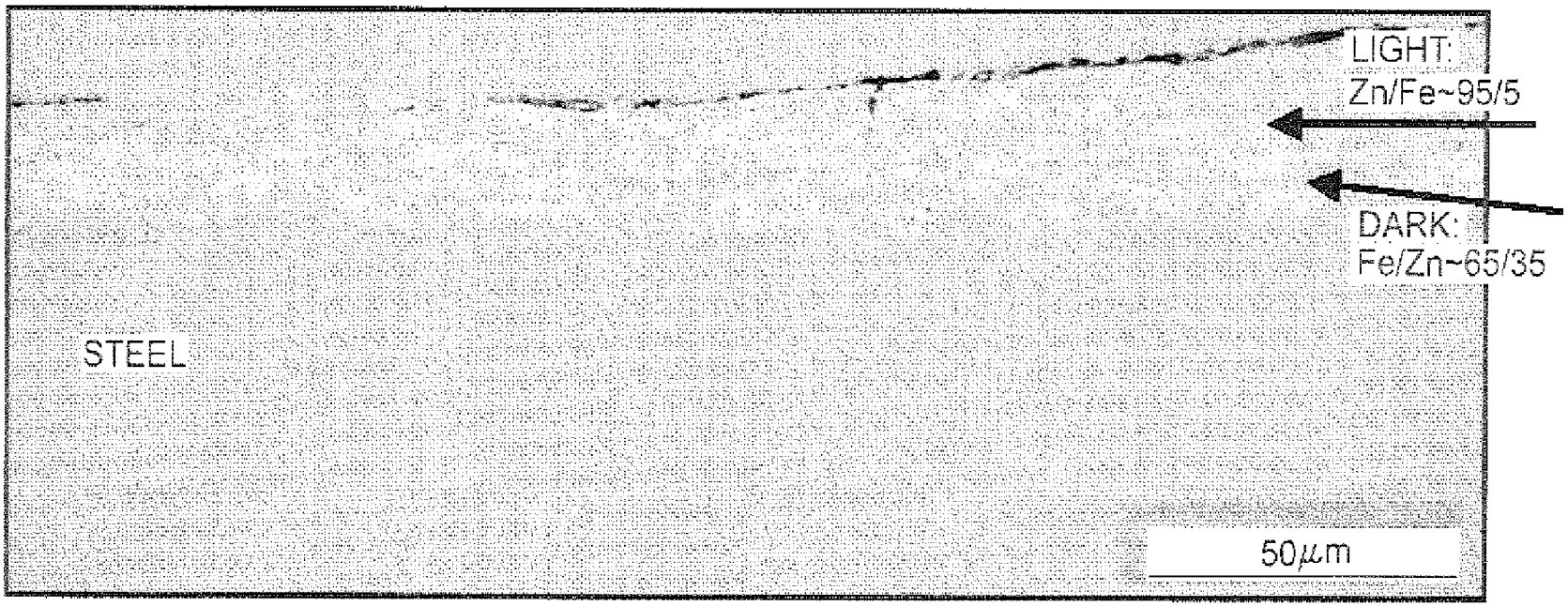
FIG. 6 shows an image taken with a light-optical microscope of the cross section of the profiled structural part produced in accordance with the invention and having the phase composition in accordance with the invention.

FIG. 3 shows a further embodiment of a device for producing the structural parts. In particular, FIG. 3 further illustrates a storage area 58 with individual storage arrangement, drive rollers 60, a galvanealing stage 62, a hardening stage 64, a cooling stage 66, an alignment frame 68, and a cutting and disposal area 70.

A profiled structural part with cathodic corrosion protection was produced in a way to be explained in what follows and was subsequently subjected to a heat treatment for hardening the profiled structural part, and to rapid cooling. Thereafter the sample was analyzed in respect to optical and electro-chemical properties. In this case the appearance of the annealed sample as well as the protection energy were evaluation criteria. The protection energy is the measure for the electro-chemical protection of the layer, which is defined by electrostatic detachment.

The electro-chemical method of electrostatic dissolution of the metallic surface coatings of a material allows the classification of the mechanism of the corrosion protection of the layer. The voltage behavior over time of a layer to be protected against corrosion is determined at a preselected constant current flow. A current density of 12.7 mA/cm$^2$ was preselected for these measurements. The measuring arrangement is a three electrode system. A platinum mesh was used as the counter-electrode, while the reference electrode consisted of Ag/AgCl(3M). The electrolyte consisted of 100 g/l of $ZnSO_4$*$5H_2O$ and 200 g/l NaCl dissolved in deionized water.

If the voltage required for dissolving the layer is greater than or equal to the steel voltage, which can be easily determined by pickling or grinding off the surface coating, this is called a pure barrier protection without an active cathodic corrosion protection. Barrier protection is distinguished in that it separates the basic material from the corrosive medium.

Example 1

In Accordance with the Invention

Figure 7:
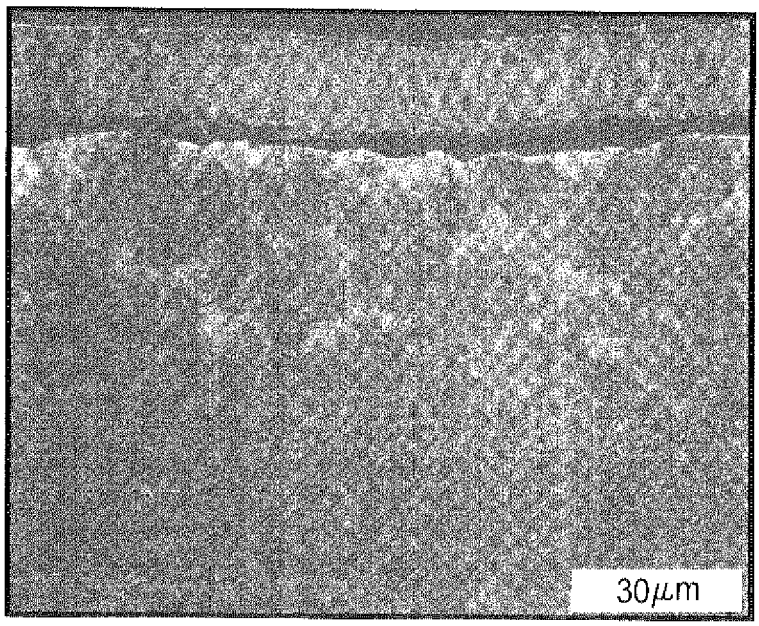
FIG. 7 is an image taken by a scanning electron microscope of the cross-grain cut of an annealed sample of a cathodic corrosion-protected sheet in accordance with the invention.

Sheet steel is hot-dip galvanized in a melt consisting of 95% zinc and 5% aluminum. After annealing, the sheet has a silvery-gray surface without blemishes. In a cross-grain cut (FIG. 7) it is shown that the coating consists of a light phase and a dark phase, wherein the phases are Zn—Fe—Al-containing phases. The light phases are more zinc-rich, the dark phases more iron-rich. A portion of the aluminum has reacted with the atmospheric oxygen during annealing and has formed a protective $Al_2O_3$ skin.

Figure 8:
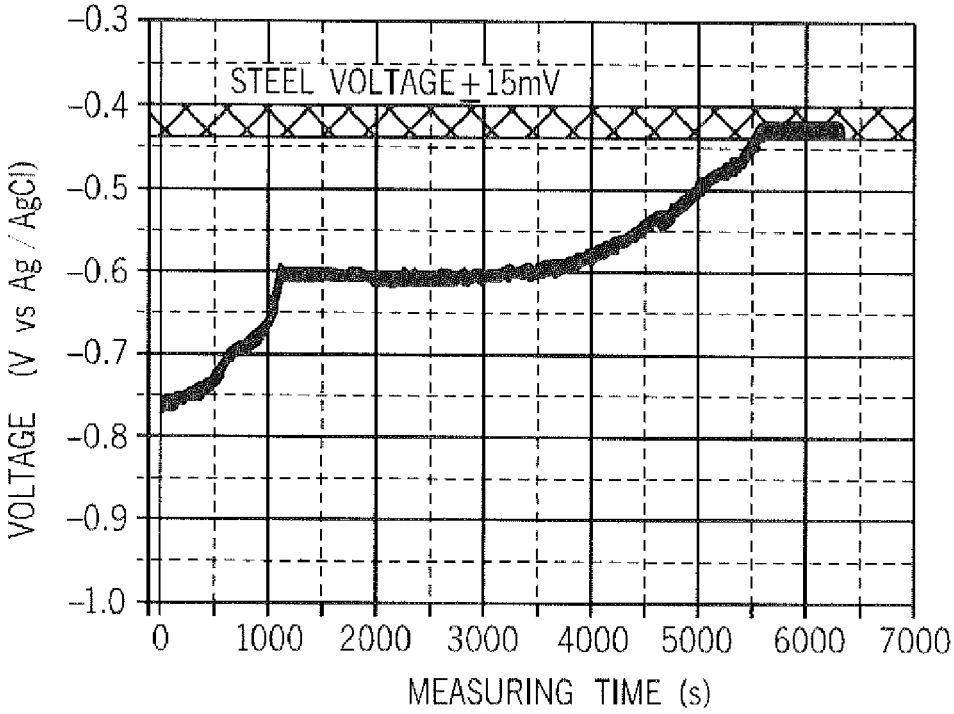
FIG. 8 shows the course of the voltage for the sheet in accordance with FIG. 7.

In the course of the electrostatic dissolution, the sheet shows at the start of the measurement a voltage of approximately −0.7 V, which is required for the dissolution. This value clearly lies below the voltage of the steel. After a measuring time of approximately 1,000 seconds a voltage of approximately −0.6 V appears. This voltage, too, still lies clearly below the steel voltage. After a measuring time of approximately 3,000 seconds this portion of the layer is used up and the voltage required for dissolving the layer nears the steel voltage. Thus, after annealing, this coating provides a cathodic corrosion protection in addition to the barrier protection. Up to a measuring time of 3,500 seconds this voltage lies around a value of ≦−0.6 V, so that a considerable cathodic protection is maintained over a long time, even if the sheet was subjected to the austenization temperature. The voltage/time diagram is represented in FIG. 8.

Example 2

In Accordance with the Invention

Figure 9:
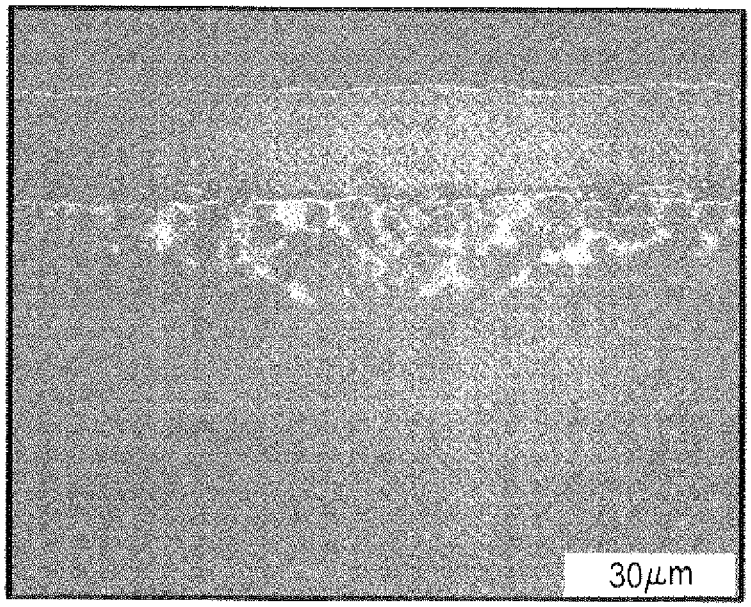
FIG. 9 is an image taken by a scanning electron microscope of the cross-grain cut of an annealed sample of a sheet provided with a cathodic corrosion protection in accordance with the invention.

The sheet is conducted through a melt or a zinc bath with a proportion of zinc of 99.8% and an aluminum content of 0.2%. Aluminum contained in the zinc coating reacts with atmospheric oxygen in the course of annealing and forms a protective $Al_2O_3$ skin. This protective skin is maintained and built up by the continuous diffusion of the aluminum, which has an affinity to oxygen. Following inductive heating of the sheet, a silvery-gray surface without blemish appears. A layer of a thickness of approximately 20 to 25 μm develops from the zinc coating, which originally was approximately 15 μm thick, wherein this layer (FIG. 9) consists of a gray-appearing phase of a composition of Zn/Fe of approximately 30/70, and of a light phase of a composition of Zn/Fe of approximately 80/20. An increased proportion of aluminum can be detected at the surface of the coating. Based on the finding of oxides at the surface it is possible to conclude that there is a thin $Al_2O_3$ protective layer present.

Figure 10:
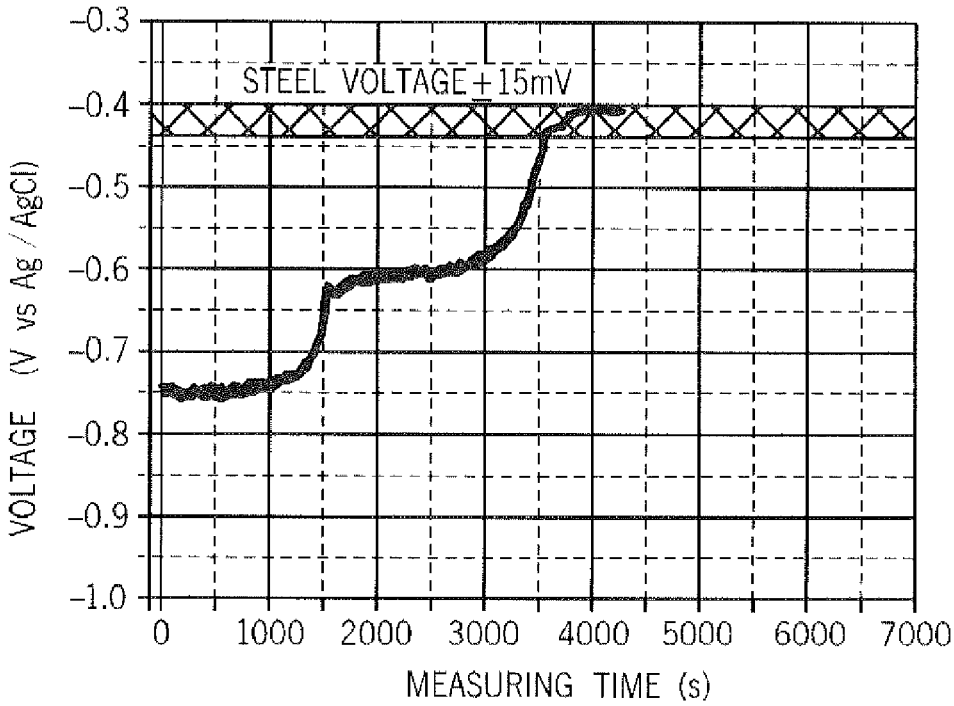
FIG. 10 shows the course of the voltage for the sheet in accordance with FIG. 9.

At the start of the electrostatic dissolution the annealed material has a voltage of approximately −0.75 V. Following a measuring time of approximately 1,500 seconds, the voltage necessary for the dissolution rises to ≦−0.6 V. The phase remains up to a measured time of approximately 2,800 seconds. Then the required voltage rises to the steel voltage. In this case, too, there is a cathodic corrosion protection in addition to the barrier protection. Up to a measured time of 2,800 seconds the value of the voltage is ≦−0.6 V. Thus, such a material also has a cathodic corrosion protection over a very long time. The voltage/time diagram can be taken from FIG. 10.

Example 3

Not in Accordance with the Invention

A profiled structural part is produced in a roller profiling installation from a sheet which was zinc-coated in a melt-dipping process. In connection with this corrosion-protection layer some aluminum of an order of magnitude of approximately 0.13% is contained in the zinc bath. Prior to austenization, the profiled structural part is heated to a temperature of approximately 500° C. In the course of this the zinc layer is converted completely into Zn—Fe phases. Therefore the zinc layer is transformed into Zn—Fe phases in its entirety, i.e. up to the surface. Zinc-rich phases result from this on the sheet steel, all of which are embodied with a Zn—Fe ratio of >70% zinc. With this corrosion-protection layer some aluminum is contained in the zinc bath at an order of magnitude of approximately 0.13%.

The profiled structural part with the mentioned, completely converted coating is heated to >900° C. by induction. A yellow-green surface is the result.

The yellow-green surface suggests oxidation of the Zn—Fe phases during annealing. No aluminum oxide protective layer can be detected. The reason for the lack of an aluminum oxide protective layer can be explained in that, in the course of the annealing treatment the aluminum cannot rapidly rise to the surface because of solid Zn—Fe phases and protect the Zn—Fe coating against oxidation. When heating this material there is no liquid, zinc-rich phase present at temperatures around 500° C., because it only is formed at higher temperatures of 782° C. Once 782° C. have been reached, a liquid zinc-rich phase exists thermodynamically, in which aluminum is freely available. The surface layer is not protected against oxidation in spite of this.

Figure 11:
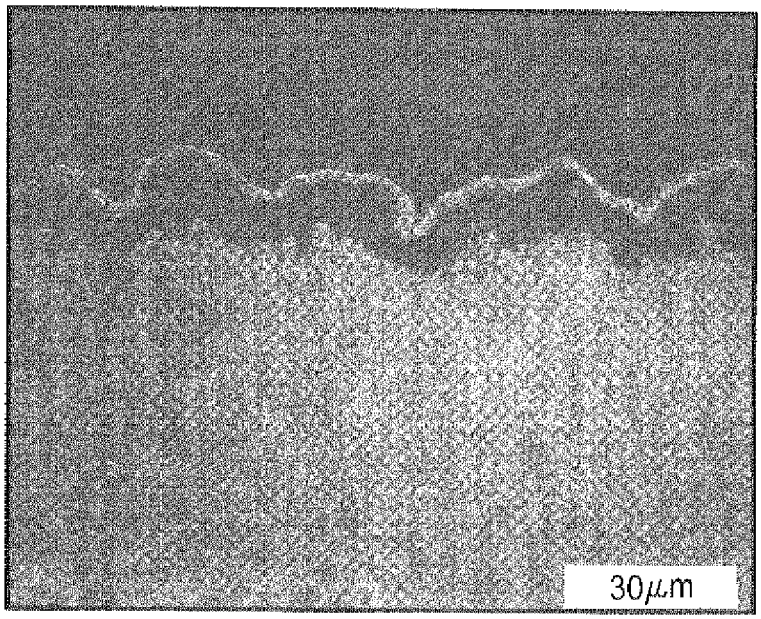
FIG. 11 is an image taken by a scanning electron microscope of the cross-grain cut of a sheet not coated and treated in accordance with the invention.

Possibly the corrosion-protection layer already exists partially oxidized at this time, and a covering aluminum oxide skin can no longer be formed. In a cross-grain cut the layer is shown to be fissured in waves and consists of Zn and Zn—Fe oxides (FIG. 11). Moreover, the surface of the mentioned material is much larger because of the highly crystalline, needle-shaped formation of the surface, which could also be disadvantageous for the formation of a covering and thicker aluminum oxide protective layer. The mentioned coating not in accordance with the invention constitutes a brittle layer which is provided with numerous cracks, transversely as well as longitudinally in relation to the coating. Because of this it is possible in the course of heating for decarbonization, as well as an oxidation of the steel substrate, to take place, particularly in connection with cold-preformed structural elements.

Figure 12:
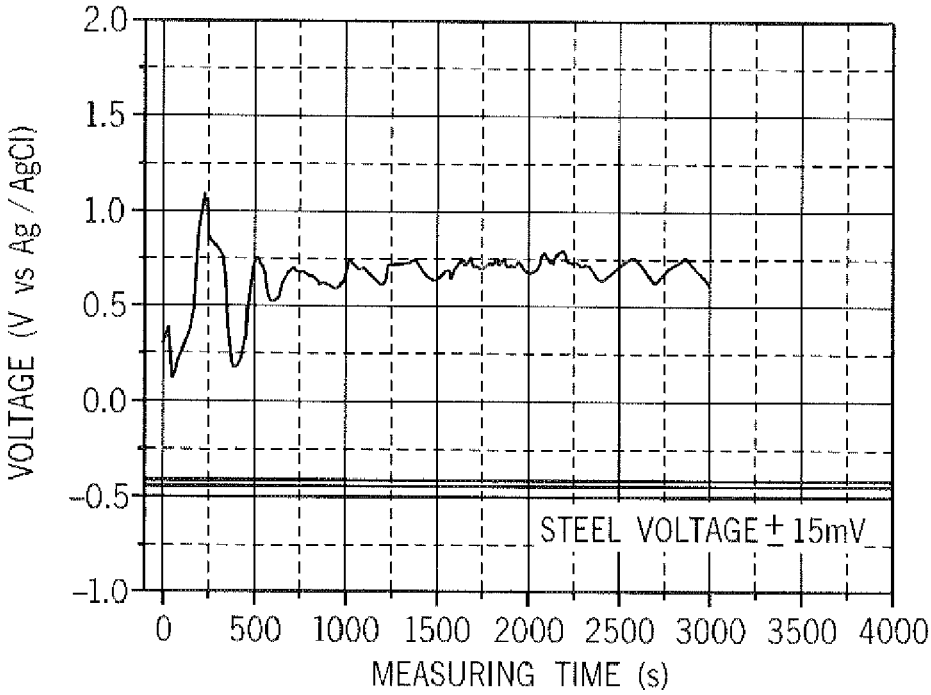
FIG. 12 shows the course of the voltage of the sheet not in accordance with the invention in FIG. 11.

In connection with the electrostatic dissolution of this material, for a dissolution under a constant current flow a voltage of approximately +1 V is applied at the start of measurement, which is then evened out to a value of approximately +0.7 V. Here, too, the voltage lies clearly above the steel voltage during the entire dissolution (FIG. 12). As a result, under these annealing conditions it is also true to speak of a pure barrier protection. In this case, too, it was not possible to detect a cathodic corrosion protection.

Example 4

In Accordance with the Invention

Following the roller forming, a profiled structural part consisting of a sheet with a zinc coating as in example 3 is subjected to a particularly short inductive heat treatment at approximately 490° C. to 550° C., wherein the zinc layer is only partially converted into Zn—Fe phases. In this case the process is performed in such a way that the phase conversion is only partially performed, so that therefore non-converted zinc with aluminum is present on the surface and in this way free aluminum is available as oxidation protection for the zinc layer.

Figure 13:
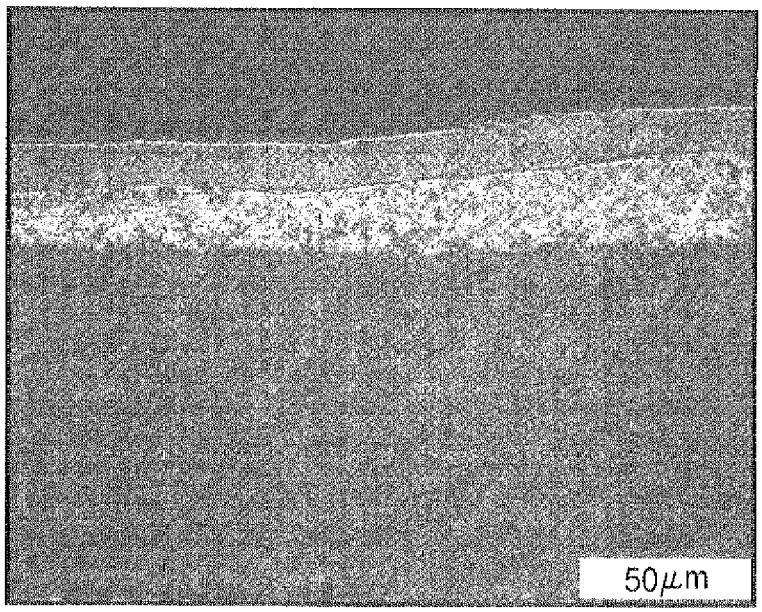
FIG. 13 is an image taken by a scanning electron microscope of the cross-grain cut of the surface of a sheet coated and heat-treated in accordance with the invention.

Subsequently the profiled structural part with the heat-treated coating in accordance with the invention, which is only partially converted into Zn—Fe phases, is rapidly inductively heated to the required austenization temperature. The result is a surface which is gray and without blemishes. A scanning electron microscope/EDX examination of the cross-grain cut (FIG. 13) shows a surface layer of approximately 20 μm thickness, wherein in the course of inductive annealing an approximately 20 μm thick Zn—Fe layer has been formed by means of diffusion from the originally approximately 15 μm thick zinc covering of the coating, wherein this layer has the typical, two-phase structure with a "leopard pattern" typical for the invention, with a phase which appears gray in the image and of a composition of Zn/Fe of approximately 80/20. Furthermore, individual areas with a zinc content of ≧90% zinc exist. A protective layer of aluminum oxide can be detected on the surface.

Figure 14:
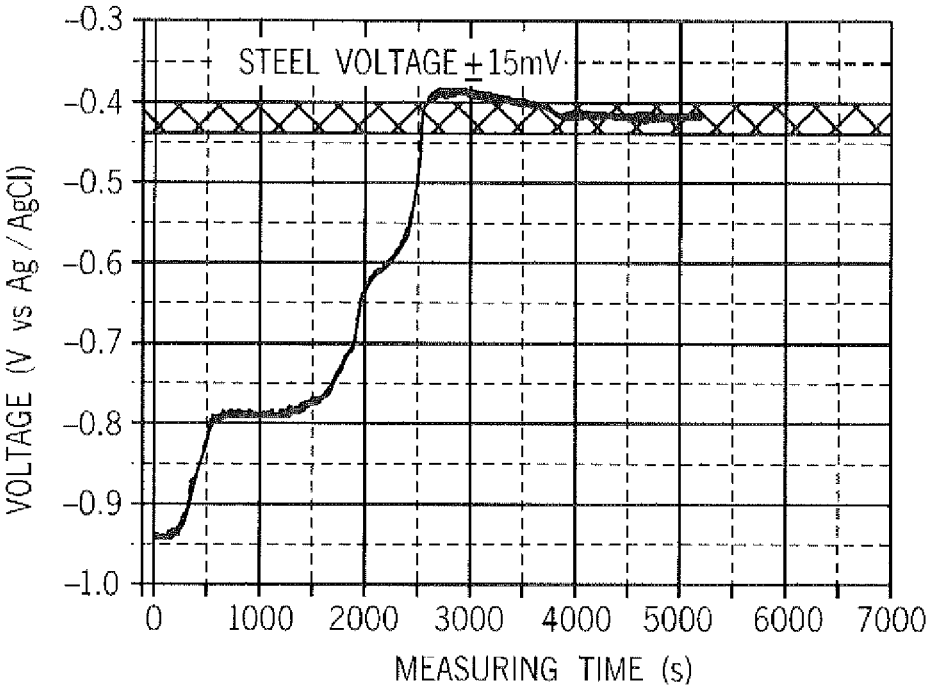
FIG. 14 shows the course of the voltage of the sheet in accordance with FIG. 13.

In the course of the electrostatic detachment of the surface coating of a rapidly heated sheet metal plate containing the hot-dip galvanized layer in accordance with the invention which, in contrast to example 2 had been heat-treated only incompletely prior to press-hardening, the result is, that at the beginning of the measurement the voltage required for the dissolution lies at approximately −0.94 V and is therefore comparable with the voltage required for dissolving a non-annealed zinc coating. After a measuring time of approximately 500 seconds the voltage rises to a value of −0.79 V and thus lies far below the steel voltage. After approximately 2,200 seconds of measuring time, ≦−0.6 V are required for the detachment, wherein subsequently the voltage rises to −0.38 V and then approaches the steel voltage (FIG. 14). A barrier protection, as well as a very good cathodic corrosion protection can form on the material in accordance with the invention, which was rapidly heated but insufficiently heat-treated prior to press hardening. With this material, too, it is possible to maintain the cathodic corrosion protection over a very long measuring time.

The examples show that, following the heat treatment, only the sheets used in accordance with the invention for roller forming still offer cathodic corrosion protection with a cathodic corrosion protection energy >4 J/cm$^2$.

For judging the quality of the cathodic corrosion protection it is not only necessary to use the time during which the cathodic corrosion protection can be maintained, but the difference between the voltage required for the dissolution and the steel voltage must also be taken into consideration. The greater this difference is, the more effective is the cathodic corrosion protection even with poorly conductive electrolytes. At a voltage difference of 100 mV in respect to the steel voltage, the cathodic corrosion protection is negligibly small in poorly conductive electrolytes. However, even at a smaller difference with the steel voltage there is in principle still a cathodic corrosion resistance present, provided an electrical current connection can be detected when using a steel electrode, however, for practical aspects this is negligibly small, since the corrosive medium must be very conductive so that this contribution can be used for the cathodic corrosion protection. For all practical purposes this is not the case under atmospheric conditions (rain water, humidity of the air, etc.). Therefore, the difference between the voltage required for the dissolution and the steel voltage was not used for the evaluation, but a threshold value of 100 mV below the steel voltage. Only the difference up to this threshold value was taken into consideration for evaluation of the cathodic protection.

The area between the voltage curve in connection with the electrostatic dissolution and the fixed threshold value of less than 100 mV below the steel voltage was fixed as the evaluation criteria for the cathodic protection of the respective surface coating after annealing (FIG. 8). Only that area which lies below the threshold value is taken into consideration. The area above it contributes negligibly little or nothing at all to cathodic corrosion protection and is therefore not considered in the evaluation.

If the area thus obtained is multiplied by the current density, it corresponds to the protective energy per unit of area, by means of which the basic material can be actively protected against corrosion. The greater this energy is, the better is the cathodic corrosion protection. While a sheet with the known aluminum-zinc coating of 55% aluminum and 44% zinc, such as is also known from the prior art, only shows a protective energy per unit of area of approximately 1.8 $J/cm^2$, the protective energy per unit of area in connection with profiled structural parts is up to >7 $J/cm^2$.

In what follows it is determined within the meaning of the invention that with coatings of 15 μm thickness and under the described process and test conditions a cathodic corrosion protection energy of at least 4 $J/cm^2$ exists.

In connection with the coatings in accordance with the invention it is typical that, besides the protective surface layer consisting of an oxide of the element(s) with affinity to oxygen used, in particular $Al_2O_3$, following the heat treatment for press hardening, cross-grain cuts of the layers in accordance with the invention display a typical "leopard pattern" consisting of a zinc-rich intermetallic Fe—Zn—Al phase and an iron-rich Fe—Zn—Al phase, wherein the iron-rich phase contains a ratio of zinc to iron of at most 0.95 ($Zn/Fe \leqq 0.95$), preferably of 0.20 to 0.80 ($Zn/Fe=0.20$ to 0.80), and the zinc-rich phase a ratio of zinc to iron of at least 2.0 ($Zn/Fe \geqq 2.0$), preferably of 2.3 to 19.0 ($Zn/Fe=2.3$ to 19.0). It was possible to determine that such a sufficient cathodic protection effect is still present only if such a two-phase structure has been achieved. But such a two-phase structure only occurs if the formation of an $Al_2O_3$ protective layer had taken place before at the surface of the coating. In contrast to a known coating in accordance with U.S. Pat. No. 6,564,062, which is homogeneously built up in respect to structure and texture, in which Zn—Fe needles in a zinc matrix are said to be present, here an inhomogeneous structure of at least two different phases is achieved. This inhomogeneous layer structure, which is manifested in the leopard pattern, is apparently also responsible for increased ductility, and therefore stability, of the layer.

A zinc layer which was deposited electrolytically on the surface of the steel sheet is not capable by itself of providing corrosion protection in accordance with the invention, even after a heating step above the austenizing temperature. However, the invention can also be achieved in connection with an electrolytically deposited coating. To this end, the zinc can be simultaneously deposited on the sheet surface together with the element(s) with affinity to oxygen in one electrolysis step, so that a coating with a homogeneous structure, which contains zinc, as well as the element(s) with affinity to oxygen, is created on the sheet surface. In the course of heating to the austenizing temperature such a coating behaves like a coating of the same composition applied to the sheet surface in the hot-dip galvanization process.

In connection with a further advantageous embodiment, zinc alone is deposited on the sheet surface in a first electrolysis step, and the element(s) with affinity to oxygen are deposited on the zinc layer in a second step. The second coating of elements with affinity to oxygen can be clearly thinner than the zinc coating. When heating such a coating in accordance with the invention, the outer layer of element(s) with affinity to oxygen present on the zinc layer is oxidized and protects the zinc underneath it by means of an oxide skin. The element with affinity to oxygen or the elements with affinity to oxygen are of course selected in such a way that they do not evaporate from the zinc layer or are oxidized in a way which does not leave a protecting oxide skin behind.

In connection with a further advantageous embodiment, first a zinc layer is electrolytically deposited, and thereafter a layer of the element(s) with affinity to oxygen is applied by vapor deposition or other suitable coating processes of a non-electrolytic type.

The corrosion protection coatings in accordance with the invention have been cited for profiling a profiled strand, or for roller forming and subsequent hardening of such a profiled strand, or sections of a profiled strand.

Regardless of this, the coatings in accordance with the invention, or the coatings which have been selected in accordance with the invention for a sheet metal element which must be subjected to a heating step, are also suitable for other methods, wherein sheet steel initially is to be provided with a corrosion-protection layer, and the sheet steel coated in this way is subsequently subjected to a heating step for hardening it, and wherein forming of the sheet is to take place prior to, during or after heating. The principal advantage of the layer is that following heating a heated structural component need not be decarbonized, and that furthermore a very good cathodic corrosion protection layer with a very high corrosion protection energy is available.

If profiled parts or tubes are mentioned in what follows, this is always meant to also identify pipes, open profiled parts and in general rolled profiled elements.

In one embodiment of the method in accordance with the invention the profiled structural part in accordance with the invention is produced in that initially a tape is conducted through an advance stamping machine and is subsequently inserted into the profiling machine. The tape is bent into a desired profile in the profiling machine. Following bending in the profiling machine, required welding is performed in a welding installation. After the profiled part has been produced inline in this way, it is conducted thereafter through a heating device, wherein the heating device is an induction coil, for example. The profiled part is heated, at least partially, to the austenizing temperature required for hardening by means of the induction coil, or the heating device. Cooling takes place thereafter. A special cooling device is used here for cooling, which prevents the partially liquid surface layer from being flushed away. This causes high rates of cooling under low fluid pressure. The special cooling device includes the dipping of the profiled part into a water bath, in which a very large amount of water is conducted over all sides of the profiled part under low pressure. In order to achieve a surface treatment of the sheet in accordance with the invention, a further heating device can be provided upstream of the induction heating device used for heating the sheet to the austenizing temperature, which heats the sheet to the first heating stage of approximately 550° C. For example, this can be an induction heating device which is followed by an insulated section, for example an insulated tunnel section, for maintaining the required chronological spacing.

A calibrating device follows the cooling device, which subjects the heated and quenched profiled strand to a calibration, after which the profiled strand is subsequently cut to the required lengths by means of a cutting unit.

In a further advantageous embodiment, tape is drawn off a tape preparation element and is perforated in the soft state in an advance stamping machine and is subsequently appropriately profiled or bent and formed in a profiling machine. If required, a welding device also follows the profiling device. The profiled strand pre-formed in this way is cut to the required length in a cutting unit or cutting installation and is transferred in the form of separate pieces to a profiled parts storage device. A multitude of profiled elements, in particular a multitude of differently embodied profiled elements, is stored in the profiled parts storage device. The desired profiled elements are drawn from the profiled parts storage device with the individual storage arrangement and are conducted to the hardening stage via a driven roller arrangement. In particular, the individual profiled elements are heated to the temperature required for hardening by means of the already described inductive heating device and are subsequently quenched in the already described manner, i.e. gently. Thereafter the hardened profiled elements can be retrofitted in a fitting installation. In an advantageous embodiment a heat treatment of the coating is performed prior to its being heated to the temperature required for hardening. For this heat treatment, the profiled element is first heated to the temperature required for the heat treatment, in particular 550° C. This heating can take place relatively rapidly in an induction heating stage wherein, if required, the heat of the structural component is maintained for a defined time in an insulation area, for example an insulated tunnel through which the profiled elements are being conducted.

In connection with a further advantageous embodiment of this method, the profiled and formed profiled strands are cut to standard profiled lengths and are subsequently conducted to the profiled parts storage device with the individual storage arrangement, wherein in this case tubes and profiled elements of a defined length, for example 6 m, are exclusively stored in the profiled parts storage device. Depending on the needed profiled element, the profiled elements are then individually removed and conducted to the appropriate further processing. With these profiled elements it is also possible, if desired, to already arrange a perforation pattern.

In connection with all mentioned methods of the invention it is possible to perform profiling, and in particular the arrangement of the perforation pattern, in such a way that heat expansion in the course of the heat treatment and/or heating to the temperature required for hardening is taken into consideration as much as possible, so that following quenching the structural part is produced exactly in regard to manufacturing and position tolerances.

In connection with the invention it is advantageous that a profiled structural part made of sheet steel is produced, which has a cathodic corrosion protection which is dependably maintained even during heating the sheet above the austenizing temperature. It furthermore is of advantage that the structural elements no longer need to be processed after hardening.

What is claimed is:

1. A method for producing a hardened profiled structural part from a hardenable steel alloy, wherein the hardened profiled structural part has cathodic corrosion protection, comprising:

applying a coating to a sheet made of a hardenable steel alloy, wherein the coating comprises zinc, and the coating further comprises one or several elements with affinity to oxygen in a total amount of 0.1 weight-% to 15 weight-% in relation to the total coating;

subsequently roller-profiling the coated sheet steel in a profiling device, so that the sheet tape is formed into a roller-formed profiled strand;

thereafter heating the coated sheet steel, at least in part and with the admission of atmospheric oxygen, to a temperature required for hardening, and heating the coated sheet steel to a structural change required for hardening; wherein a skin made of an oxide of the element(s) with affinity to oxygen is formed on the surface of the coating thus imparting cathodic corrosion protection; and after sufficient heating, cooling the sheet, wherein the rate of cooling is set in such a way that hardening of the sheet alloy is achieved.

2. The method in accordance with claim 1, comprising welding the profiled strand, which was profiled in a profiling installation, in a downstream-located welding device.

3. The method in accordance with claim 1, comprising cutting the profiled strand into profiled strand sections prior to heating the profiled strand to the temperature required for hardening.

4. The method in accordance with claim 3, comprising heating the profiled strand or the profiled strand sections, prior to being heated to the temperature required for hardening, in a heating step to a temperature that makes possible the partial formation of iron-zinc phases in the coating, and maintaining the profiled strand or the profiled strand sections at this temperature.

5. The method in accordance with claim 3, comprising providing holes, cutouts, punched-out places and/or a required perforation pattern in the profiled strand or the profiled strands sections, prior to or following profiling and/or prior to or following the cutting to size, and prior to heating to the temperature required for hardening.

6. The method in accordance with claim 1, comprising heating the profiled strand or the profiled strand sections to a temperature of 850° C. to 950° C. at a heating rate of 50° C. to 100° C. per second, and maintaining the profiled strand or the profiled strand sections at this temperature for at least 5 seconds, and cooling the profiled strand or the profiled strand sections at a cooling rate of 25° C. to 45° C. per second.

7. The method in accordance with claim 1, comprising, in the course of heating, maintaining the profiled strand or the profiled strand sections at 500° C. to 600° C. for at least 10 seconds, and subsequently further heating the profiled strand or the profiled strand sections.

8. The method in accordance with claim 1, comprising heating the profiled strand and/or the profiled strand sections inductively and/or by convection and/or by radiation.

9. The method in accordance with claim 1, comprising cooling the sheet in water.

10. The method in accordance with claim 1, wherein magnesium and/or silicon and/or titanium and/or calcium and/or aluminum and/or manganese and/or boron are used in the mixture as elements with affinity to oxygen.

11. The method in accordance with claim 1, comprising applying the coating using a hot-dip galvanization process, in which a mixture of zinc with the element(s) with affinity to oxygen is used.

12. The method in accordance with claim 1, comprising applying the coating electrolytically.

13. The method in accordance with claim 12, wherein in the course of the electrolytic coating first a zinc layer is deposited, and thereafter the element(s) with affinity to oxygen is (are) deposited on the applied zinc coating in a second step.

14. The method in accordance with claim 12, comprising initially electrolytically depositing a zinc coating on the surface of the sheet, and subsequently applying a coating of the element(s) with affinity to oxygen to the zinc surface.

15. The method in accordance with claim 14, comprising applying the element(s) with affinity to oxygen by vapor deposition.

16. The method in accordance with claim 1, wherein 0.2 weight-% to 5 weight-% of the elements with affinity to oxygen are used.

17. The method in accordance with claim 1, wherein 0.26 weight-% to 2.5 weight-% of the elements with affinity to oxygen are used.

18. The method in accordance with claim 1, wherein aluminum is substantially employed as the element with affinity to oxygen.

19. The method in accordance with claim 1, wherein the coating mixture is selected in such a way that in the course of heating the layer forms a surface oxide skin made of oxides of the elements with affinity to oxygen and the coating forms at least two phases, wherein a zinc-rich phase and an iron-rich phase are formed.

20. The method in accordance with claim 19, wherein the iron-rich phase is embodied to have a ratio of zinc to iron of at most 0.95 ($Zn/Fe \leqq 0.95$), and the zinc-rich phase a ratio of zinc to iron of at least 2.0 ($Zn/Fe \geqq 2.0$).

21. The method in accordance with claim 19, wherein the iron-rich phase has a ratio of zinc to iron of approximately 30:70, and the zinc-rich face is embodied with a ratio of zinc to iron of approximately 80:20.

22. The method in accordance with claim 19, wherein the layer contains individual areas with zinc proportions >90% zinc.

23. The method in accordance with claim 1, wherein the coating is formed in such a way that, at a thickness of 15 μm, it develops a cathodic protection effect of at least 4 $J/cm^2$ after heating.

24. The method in accordance with claim 1, comprising coating the sheet with the mixture of zinc and the element(s) with affinity to oxygen during passage of the sheet through a liquid metal bath at a temperature of 425° C. to 690° C. and subsequently cooling the coated sheet.

25. The method in accordance with claim 1, comprising coating the sheet with the mixture of zinc and the element(s) with affinity to oxygen during passage of the sheet through a liquid metal bath at a temperature of 440° C. to 495° C. and subsequently cooling the coated sheet.

26. The method in accordance with claim 1, comprising inductively heating the sheet.

27. The method in accordance with claim 1, comprising heating the sheet in a radiation furnace.

28. The method in accordance with claim 1, comprising forming and hardening the structural component in a roller forming installation, wherein the coated sheet is heated, at least in parts, to the austenizing temperature, is subsequently roller-formed prior to, during and/or after this and, following the roller forming, is cooled at a rate of cooling which causes hardening of the sheet alloy.

* * * * *